US010253509B2

(12) United States Patent
Connor et al.

(10) Patent No.: US 10,253,509 B2
(45) Date of Patent: Apr. 9, 2019

(54) CORNER CONSTRUCTION SYSTEM AND METHOD OF INSTALLING SAME

(71) Applicant: ATAS International, Inc., Allentown, PA (US)

(72) Inventors: Kevin Connor, Schwenksville, PA (US); Theodorus A. Bus, Orefield, PA (US)

(73) Assignee: ATAS International, Inc., Allentown, PA (US)

( * ) Notice: Subject to any disclaimer, the term of this patent is extended or adjusted under 35 U.S.C. 154(b) by 0 days.

(21) Appl. No.: 15/221,679

(22) Filed: Jul. 28, 2016

(65) Prior Publication Data

US 2017/0030085 A1 Feb. 2, 2017

Related U.S. Application Data

(60) Provisional application No. 62/198,171, filed on Jul. 29, 2015.

(51) Int. Cl.
*E04B 1/00* (2006.01)
*E04F 19/06* (2006.01)

(52) U.S. Cl.
CPC ..... *E04F 19/064* (2013.01)

(58) Field of Classification Search
CPC ..... E04F 13/0733
USPC ..... 52/254, 255
See application file for complete search history.

(56) References Cited

U.S. PATENT DOCUMENTS

| | | | | |
|---|---|---|---|---|
| 3,338,012 | A | 8/1967 | Kappenhagen et al. | |
| 3,381,430 | A * | 5/1968 | Wiczer | E04B 1/6116 52/282.3 |
| 3,465,487 | A | 9/1969 | Fatosme et al. | |
| 3,722,166 | A | 3/1973 | Mcnerney | |
| 4,385,850 | A * | 5/1983 | Bobath | F16B 5/0068 403/205 |
| 4,430,833 | A * | 2/1984 | Balzer | E04F 19/028 52/255 |
| 4,507,815 | A | 4/1985 | Danko | |
| 6,219,980 | B1 * | 4/2001 | Peck, Jr. | E04F 19/028 52/255 |
| 6,647,679 | B2 * | 11/2003 | Belleau | E04F 13/06 52/254 |
| 6,691,481 | B2 | 2/2004 | Schmidt | |
| 7,861,479 | B2 | 1/2011 | Crosby et al. | |
| 8,011,849 | B2 | 9/2011 | Williams | |
| 8,522,498 | B2 | 9/2013 | Picken | |
| 2009/0224642 | A1 | 9/2009 | Murphy | |
| 2013/0308999 | A1 | 11/2013 | Black | |

* cited by examiner

*Primary Examiner* — Basil S Katcheves
(74) *Attorney, Agent, or Firm* — Design IP

(57) ABSTRACT

The present application discloses a wall panel and corner construction system for installation onto a building structure, and methods for installing same.

19 Claims, 5 Drawing Sheets

CORNER CONSTRUCTION SYSTEM AND METHOD OF INSTALLING SAME

FIELD OF THE INVENTION

The present invention relates to construction of paneling, and more particularly to paneling for installation onto the exterior of structures.

BACKGROUND

Wall panels are used as a siding or roofing material on various types of structures. The corners of these structures require weatherproof seals to prevent water from entering behind the wall panels. In prior art corner construction systems, wall panels are roughly installed up to a corner of a structure and then the ends of the panels are covered by corner caps or a corner post to conceal the ends of the wall panels and prevent water and debris from entering behind the wall panels. These corner structures are unsightly and stick out from the corner of the structure.

Accordingly, there is a need for a corner construction system and method of installing same that are improvements over existing devices and methods.

BRIEF DESCRIPTION OF THE DRAWINGS

The corner construction system according to the present invention is further described with reference to the accompanying drawings, in which.

DETAILED DESCRIPTION OF THE PREFERRED EMBODIMENTS

Figure 1:
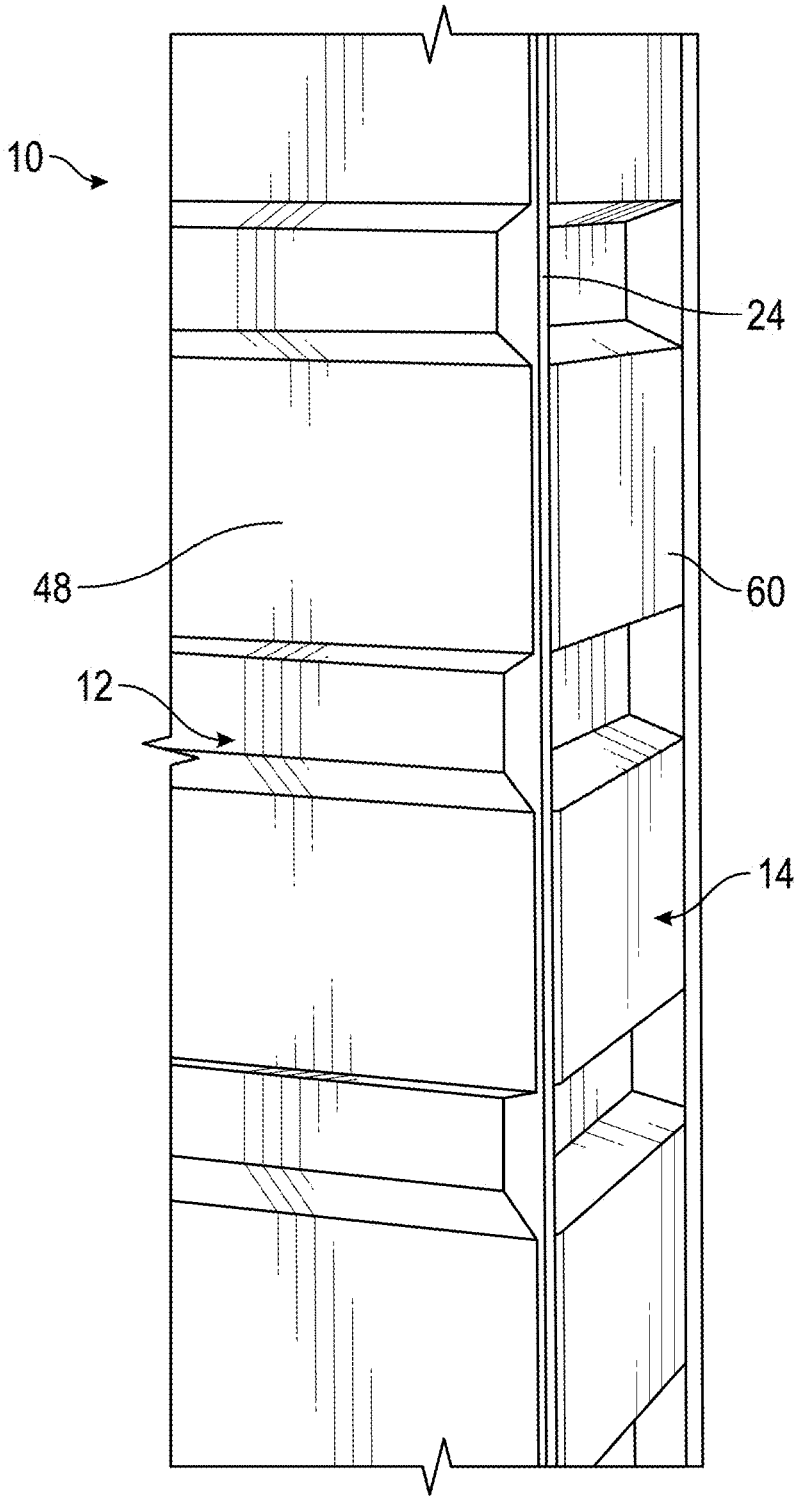
FIG. 1 shows a perspective view of an embodiment of a corner construction system according to the present invention.

The ensuing detailed description provides preferred exemplary embodiments only, and is not intended to limit the scope, applicability, or configuration of the herein disclosed inventions. Rather, the ensuing detailed description of the preferred exemplary embodiments will provide those skilled in the art with an enabling description for implementing the preferred exemplary embodiments in accordance with the herein disclosed invention. It should be understood that various changes may be made in the function and arrangement of elements without departing from the spirit and scope of the invention, as set forth in the appended claims.

To aid in describing the invention, directional terms may be used in the specification and claims to describe portions of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification, in order to provide context for other features.

For purposes of the present specification and accompanying claims, the term "adjacent" means either "in close vicinity to" or "in direct contact with."

For purposes of the present specification and accompanying claims, the term "overlies" means "located superficial to" or "located on top of."

For purposes of the present specification and accompanying claims, the term "substantially" used with respect to a geometric relationship, for example "substantially parallel" means within plus or minus 5 degrees of that relationship proper.

Figure 2:
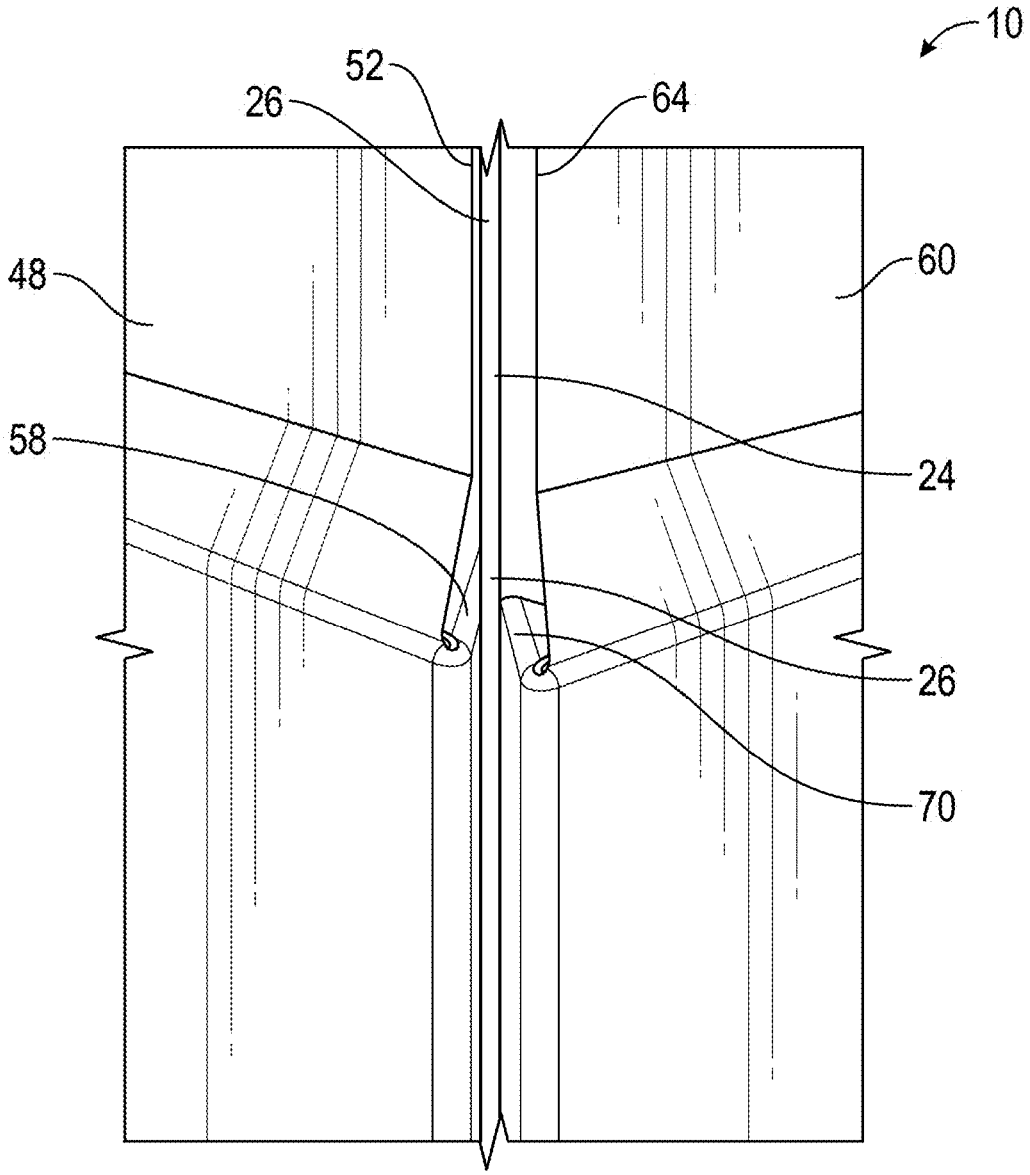
FIG. 2 shows a front perspective view thereof.
Figure 3:
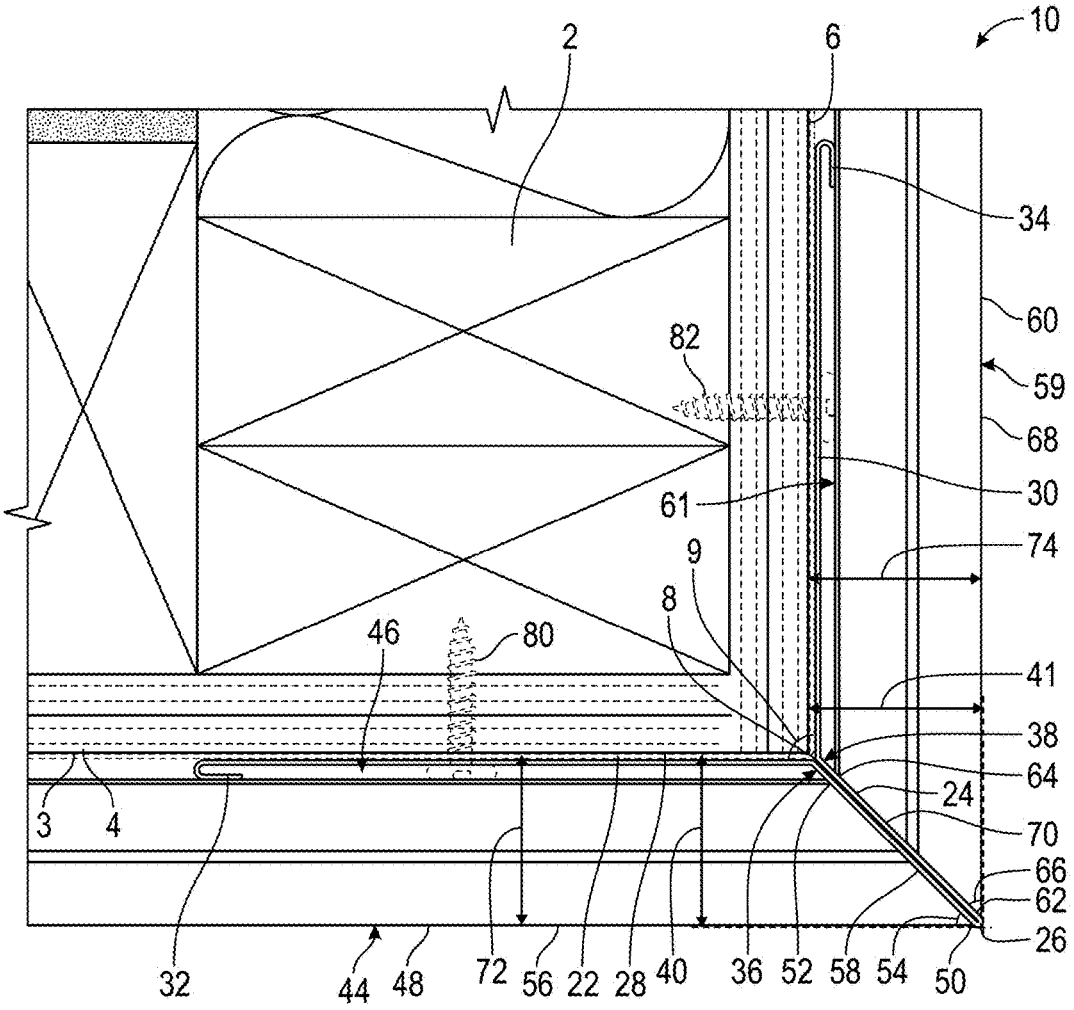
FIG. 3 shows a schematic sectional view of the embodiment of FIG. 1 taken through a horizontal plane and viewed from the top.

FIGS. 1-3 generally show an embodiment of a corner construction system 10 in accordance with the present invention. In this embodiment, the system 10 comprises a first array of wall panels 12 that is attachable to such that it overlies a first wall 4 of a structure 2 and a second array of wall panels 14 that is attachable to such that it overlies a second wall 6 of the structure 2. As shown in FIG. 1, the first array of wall panels 12 comprises a first wall panel 48 and the second array of wall panels 14 comprises a second wall panel 60. The system 10 further comprises a corner bracket 22 that, once attached to the structure 2, overlies a corner 8 of the structure 2. The corner 8 of the structure 2 has an interior angle 9, which in this embodiment has a value of 90 degrees. A suitable underlayment 3, for example a housewrap material such as Tyvek® produced by E. I. du Pont de Nemours and Company of Wilmington, Del., is provided between the structure 2 and the corner construction system 10 prior to installation of the system 10 on the structure 2.

Figure 4:
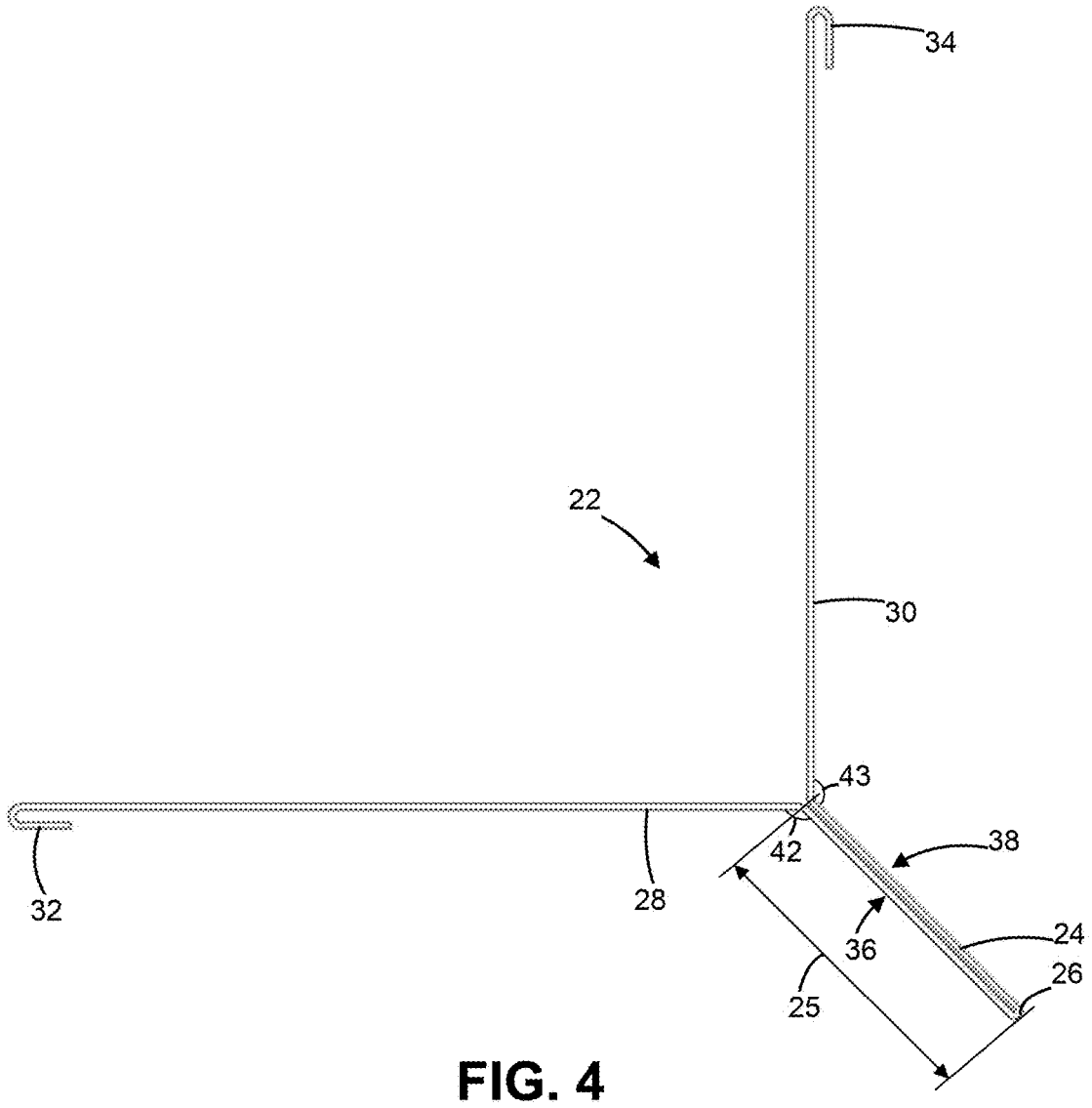
FIG. 4 show a top plan schematic view of a corner bracket thereof.

FIG. 4 shows the corner bracket 22 of the system 10. In this embodiment, the corner bracket 22 comprises a first flange 28 having a flat portion 31 and a protruding portion 32, a second flange 30 having a flat portion 33 and a protruding portion 34, and a corner protrusion 24 having a length 25 and a bend 26 at a distal end thereof. Referring back to FIG. 3, the corner bracket 22 is installed onto the structure 2 by placing the corner bracket 22 adjacent to the structure 2 such that the corner protrusion overlies the corner 8 of the structure, the flat portion 31 is located adjacent to the first wall 4, and the flat portion 33 is located adjacent to the second wall 6, then the flat portion 31 is attached to the first wall 4 via a suitable fastener 80 and the flat portion 33 is attached to the first wall 4 via a suitable fastener 82. It should be understood that FIG. 3 is depicting a cross-sectional view of the system 10 viewed from the top, and that a vertical row of fasteners will be used to attach both the first flange 28 and the second flange 30 to the structure 2. When the corner bracket 22 is attached to the structure 2 in this fashion, the corner protrusion 24 extends away from the first wall 4 a first distance 40 that is measured orthogonally from the first wall 4, the corner protrusion 24 extends away from the second wall 6 a second distance 41 that is measured orthogonally from the second wall 6, the protruding portion 32 extends away from the first wall 4, and the protruding portion 34 extends away from the second wall 6.

The corner protrusion 24 has a first side 36 and a second side 38. The corner protrusion 24 extends away from the flat portion 31 of the first flange 28 at a first protrusion angle 42 and extends away from the flat portion 33 of the second flange 30 at a second protrusion angle 43. In this embodiment, both the first protrusion angle 42 and the second protrusion angle 43 have a value of 135 degrees, such that the corner bracket 22 is designed to be used for a structure 2 having a 90 degree (right angle) interior corner (i.e., a 270 degree exterior corner which is bisected by the corner protrusion 24). In alternate embodiments, the first protrusion angle 42 and second protrusion angle 43 could have different or equal values between 90 and 180 degrees (obtuse angles), or could have different or equal values less than 90 degrees (acute angles) if the corner bracket 22 is used for a corner of a structure having an interior angle greater than 180 degrees (i.e., a reflex angle). As would be appreciated by one of ordinary skill in the art, while the individual values of the angles are adjustable based on the geometry of the structure 2, the sums of the first protrusion angle 42, second protrusion angle 43, and the interior angle 9 of the corner 8 of the structure 2 will sum to approximately 360 degrees. For example, if the interior angle 9 of the corner 8 of the structure 2 had a value of 120 degrees, the first protrusion angle 42 and second protrusion angle 43 would have a combined value of approximately 240 degrees, and could for example have values of approximately 120 degrees each.

In this embodiment, the first wall panel 48 has an end 52, an interior surface 46, and an exterior surface 44 opposing the interior surface 46. When the first wall panel 48 is attached to the first wall 4 of the structure 2 such that the end 52 of the first wall panel 48 is located adjacent to the first side 36 of the corner protrusion 24 and the interior surface 46 of the first wall panel 48 contacts the protruding portion 32 of the first flange 28, a depth 72 of the first wall panel that is measured orthogonally between the first wall 4 and the exterior surface 44 of the first wall panel 48 is no greater than the first distance 40 (such that the exterior surface 44 of the first wall panel 48 does not extend out beyond the corner protrusion 24). In this embodiment, the second wall panel 60 has an end 64, an interior surface 61, and an exterior surface 59 opposing the interior surface 61. When the second wall panel 60 is attached to the second wall 6 of the structure 2 such that the end 64 of the second wall panel 60 is located adjacent to the second side 38 of the corner protrusion 24 and the interior surface 61 of the second wall panel 60 contacts the protruding portion 34 of the second flange 30, a depth 74 of the second wall panel 60 that is measured orthogonally between the second wall 6 and the exterior surface 59 of the second wall panel 60 is no greater than the second distance 41 (such that the exterior surface 59 of the second wall panel 60 does not extend out beyond the corner protrusion 24).

In this embodiment, the first wall panel 48 is comprised of a main portion 56 and a return portion 58 that is separated from the main portion 56 by a bend 50. The bend 50 has an interior angle 54. In this embodiment, the value of the interior angle 54 is supplementary to the value of the first protrusion angle 42, i.e., these values sum to 180 degrees, such that the return portion 58 is parallel to the first side 36 of the corner protrusion 24 once the first wall panel 48 is installed on the first wall 4 such that the exterior surface 44 of the first wall panel 48 lies in a plane that is parallel to a plane of the first wall 4. In alternate embodiments, the return portion 58 of the first wall panel 48 is substantially parallel to the first side 36 of the corner protrusion 24 once the first wall panel 48 is installed. In further alternate embodiments, the return portion 58 of the first wall panel 48 need not be parallel or substantially parallel to the first side 36 of the corner protrusion 24 once the first wall panel 48 is installed, and optionally comes into contact with some portion of the first side 36 of the corner protrusion 24. Although the return portion 58 is preferable because it prevents ingress of water and debris into the system 10, in still further alternate embodiments the return portion 58 need not be provided at all and the end 52 of the first wall panel 48, which is unbent, could be placed adjacent to the first side 36 of the corner protrusion 24.

In this embodiment, the second wall panel 60 is comprised of a main portion 68 and a return portion 70 that is separated from the main portion 68 by a bend 62. The bend 62 has an interior angle 66. In this embodiment, the value of the interior angle 66 is supplementary to the value of the second protrusion angle 43, i.e., these values sum to 180 degrees, such that the return portion 70 is parallel to the second side 38 of the corner protrusion 24 once the second wall panel 60 is installed on the second wall 6 such that the exterior surface 59 of the second wall panel 60 lies in a plane that is parallel to a plane of the second wall 6. In alternate embodiments, the return portion 70 of the second wall panel 60 is substantially parallel to the second side 38 of the corner protrusion 24 once the second wall panel 60 is installed. In further alternate embodiments, the return portion 70 of the second wall panel 60 need not be parallel or substantially parallel to the second side 38 of the corner protrusion 24 once the second wall panel 60 is installed, and optionally comes into contact with some portion of the second side 38 of the corner protrusion 24. Although the return portion 70 is preferable because it prevents ingress of water and debris into the system 10, in still further alternate embodiments the return portion 70 need not be provided at all and the end 64 of the second wall panel 60, which is unbent, could be placed adjacent to the second side 38 of the corner protrusion 24.

The first wall panel 48 and second wall panel 60 may be delivered to the installation site without any bend, and an installer may cut each wall panel 48,60 to length and create the respective bend 50,62 once the relevant wall length and accompanying wall panel length has been determined. In the alternative, all wall panels could be pre-bent or pre-marked for the bend location before delivery to the installation site based on previously-collected measurements. The maximum lengths of the return portions of the wall panels that may be provided is determined by the depth of the particular wall panel being used (as measured between its interior and exterior surfaces) and the protrusion angles 42,43 of the corner protrusion 24 of the corner bracket 22. Likewise, the length 25 of the corner protrusion 24 of the corner bracket 22 is determined by reference to the depths of the wall panels being used for the wall panel arrays 12, 14 and the protrusion angles 42,43 of the corner protrusion 24. The corner bracket 22 may be delivered to the installation site pre-formed according to the height of the corner 8 of the structure 2 to which it is to be installed, could be pre-marked for the bend locations, or may be formed on-site by bending a sheet of metal of the appropriate length and width to form the corner bracket 22. Thus, an advantage of the corner construction system 10 according to the present invention is that its components may be produced of sheet metal and shipped to the consumer flat, thus reducing the amount of shipping volume required to transport the components. An additional advantage is that an installer can use a flat piece of sheet metal to make corner brackets of various dimensions in accordance with the present invention based on the specifications of the structure and the wall panels that are to be used. If the corner bracket 22 is pre-formed, the corner protrusion 24 could be comprised of a single portion of the wall panel that extends from the flanges 28,30. In other words, no bend 26 is necessary at the end of the length 25 of the corner protrusion 24, as the corner protrusion 24 is formed in some way that does not necessitate bending a piece of metal in order to form it.

In this embodiment, the protruding portions 32,34 of the corner bracket 22 are formed in a hooked, curved, or "J" shape. When the wall panels 48,60 are installed on the structure 2 and the respective interior surface 46,61 is placed in contact with the respective protruding portion 32,34, a physical barrier is provided that prevents the flow of rain water or other debris that may enter the corner construction system 10 laterally past the protruding portions 32,34. In alternate embodiments, the protruding portions 32,34 may be of other shapes, for example a squared-off hook, straight protrusion, or angled protrusion, or the protruding portions 32,34 may be omitted entirely. In the embodiment shown in FIGS. 1-4, the protruding portions 32,34 are each located at an end of a respective one of the flanges 28,30. In alternate embodiments, the protruding portions 32,34 need not be located at the end of the flanges 28,30. In the embodiment shown in FIGS. 1-4, the protruding portions 32,34 bend back towards the corner protrusion 24 of the corner bracket 22. In alternate embodiments, the protruding portions 32,34 may run perpendicularly to the respective wall 4,6 of the structure 2, or may be bent away from the corner protrusion 24.

In the present embodiment, the corner bracket 22 and wall panels 48, 60 are comprised of metal. In alternate embodiments, the corner bracket and wall panels could be comprised of other materials, for example vinyl or other plastics, various woods, or composites.

Figure 5:
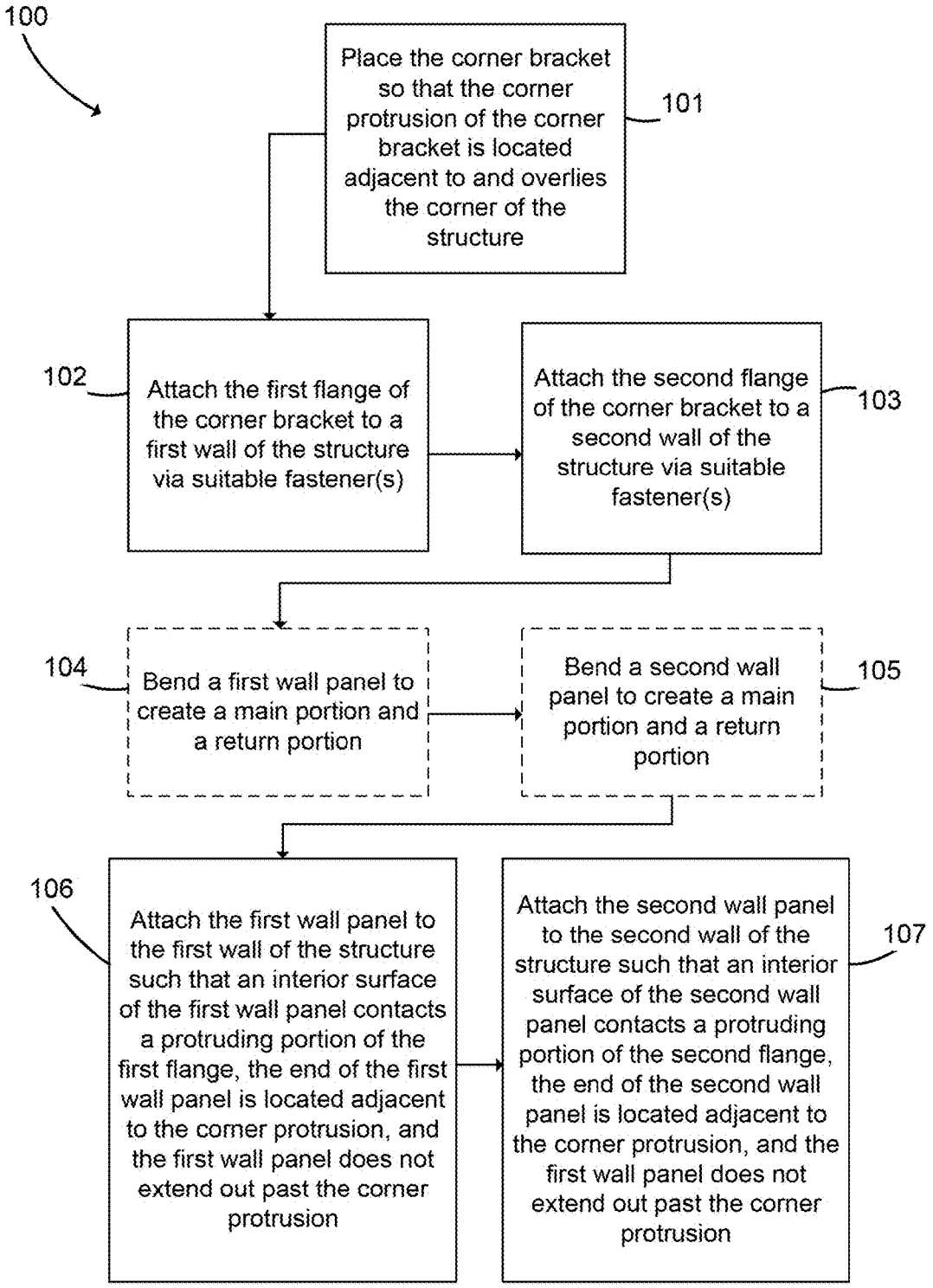
FIG. 5 is a flow chart showing the steps of installing an embodiment of the corner construction system according to the present invention.

FIG. 5 shows a flow chart outlining an embodiment of a method 100 of installing the corner construction system 10 on a structure 2 in accordance with the present invention. In step 101, the corner bracket 22 is placed so that the corner protrusion 24 thereof is located adjacent to and overlies the corner 8 of the structure 2. In step 102, the first flange 28 of the corner bracket 22 is attached to the first wall 4 of the structure 2 via suitable fastener(s) 80. In step 103, the second flange 30 of the corner bracket 22 is attached to the second wall 6 of the structure 2 via suitable fastener(s) 82. In optional step 104, the first wall panel 48 is bent to create a main portion 56 and a return portion 58, and in optional step 105 the second wall panel 60 is bent to create a main portion 68 and a return portion 70. In step 106, the first wall panel 48 is attached to the first wall 4 of the structure 2 such that an interior surface 46 of the first wall panel 48 contacts a protruding portion 32 of the first flange 28, the end 52 of the first wall panel 48 is located adjacent to the corner protrusion 24, and the first wall panel 48 does not extend out further than the corner protrusion 24. Finally, in step 107, the second wall panel 60 is attached to the second wall 6 of the structure 2 such that an interior surface 61 of the second wall panel 60 contacts a protruding portion 34 of the second flange 30, the end 64 of the second wall panel 60 is located adjacent to the corner protrusion 24, and the second wall panel 60 does not extend out further than the corner protrusion 24. Additional wall panels and/or cornet brackets, as necessary, could then be installed onto the structure, in accordance with the steps set forth above.

An exemplary order of steps of the method 100 according to the present invention has been set forth above. One of ordinary skill in the art would recognize that some of the steps could be reordered, combined, and/or omitted while keeping within the scope and spirit of the present invention.

Although exemplary implementations of the herein described device and method have been described in detail above, those skilled in the art will readily appreciate that many additional modifications are possible in the exemplary embodiment(s) without materially departing from the novel teachings and advantages of the herein described device and method. Accordingly, these and all such modifications are intended to be included within the scope of the herein described device and method. The herein described device and method may be better defined by the following exemplary claims.

What is claimed is:

1. A corner construction system adapted for installation onto a structure, the structure having a corner, a first wall, and a second wall, the first and second walls meeting at and each extending away from the corner, the corner construction system comprising:

a corner bracket comprising a corner protrusion having a first side and a second side, a first flange having a flat portion and a protruding portion, and a second flange having a flat portion and a protruding portion, the first and second flanges extending away from the corner protrusion, wherein when the corner bracket is attached to the structure such that the corner protrusion is adjacent to and overlies the corner of the structure, the flat portion of the first flange is located adjacent to the first wall, and the flat portion of the second flange is located adjacent to the second wall, the corner protrusion extends away from the first wall a first distance that is measured orthogonally from the first wall, the corner protrusion extends away from the second wall a second distance that is measured orthogonally from the second wall, the protruding portion of the first flange extends away from the first wall, and the protruding portion of the second flange extends away from the second wall;

a first wall panel having an end, an interior surface, and an exterior surface opposing the interior surface, wherein when the first wall panel is attached to the first wall such that the end of the first wall panel is located adjacent to the first side of the corner protrusion and the interior surface of the first wall panel contacts the protruding portion of the first flange, a third distance that is measured orthogonally between the first wall and the exterior surface of the first wall panel is no greater than the first distance; and a second wall panel having an end, an interior surface, and an exterior surface opposing the interior surface, wherein when the second wall panel is attached to the second wall such that the end of the second wall panel is located adjacent to the second side of the corner protrusion and the interior surface of the second wall panel contacts the protruding portion of the second flange, a fourth distance that is measured orthogonally between the second wall and the exterior surface of the second wall panel is no greater than the second distance.

2. The corner construction system of claim 1, wherein the third distance is less than the first distance and the fourth distance is less than the second distance.

3. The corner construction system of claim 1, wherein the protruding portion of the first flange is located at an end of the first flange located opposite to the corner protrusion and the protruding portion of the second flange is located at an end of the second flange located opposite to the corner protrusion.

4. The corner construction system of claim 1, wherein the corner protrusion extends away from the flat portion of the first flange at a first protrusion angle, the first protrusion angle having a value between 90 and 180 degrees.

5. The corner construction system of claim 4, wherein the first protrusion angle has a value of 135 degrees.

6. The corner construction system of claim 1, the end of the first wall panel including a bend that separates a main portion of the first wall panel from a return portion of the first wall panel, the return portion of the first wall panel being routed towards the corner of the structure, wherein the bend has an interior angle having a value between 5 and 90 degrees.

7. The corner construction system of claim 6, the end of the second wall panel including a bend that separates a main portion of the second wall panel from a return portion of the second wall panel, the return portion of the second wall panel being routed towards the corner of the structure, wherein the bend has an interior angle having a value between 5 and 90 degrees.

8. The corner construction system of claim 1, wherein the protruding portion of the first flange extends away from the flat portion thereof towards the corner protrusion.

9. The corner construction system of claim 1, wherein the protruding portion of the first flange is hooked or curved.

10. The corner construction system of claim 1, wherein the corner protrusion comprises a bend at a distal end thereof, wherein when the corner construction system is installed on the structure, the bend remains exposed.

11. The corner construction system of claim 1, wherein the corner protrusion is disposed between the end of the first wall panel and the end of the second wall panel.

12. The corner construction system of claim 1, wherein the third distance is measured adjacent to the corner protrusion and the fourth distance is measured adjacent to the corner protrusion.

13. A method of installing a corner construction system onto a structure, the structure having a corner, a first wall, and a second wall, the first and second walls meeting at and each extending away from the corner, the method comprising:

attaching a corner bracket to the structure such that a corner protrusion of the corner bracket is located adjacent to and overlies the corner of the structure, a flat portion of a first flange of the corner bracket is located adjacent to the first wall, a flat portion of a second flange of the corner bracket is located adjacent to the second wall, the corner protrusion extends away from the first wall a first distance that is measured orthogonally from the first wall, the corner protrusion extends away from the second wall a second distance that is measured orthogonally from the second wall, a protruding portion of the first flange extends away from the first wall, and a protruding portion of the second flange extends away from the second wall;

attaching a first wall panel having an end, an interior surface, and an exterior surface opposing the interior surface to the first wall such that the end of the first wall panel is located adjacent to a first side of the corner protrusion, the interior surface of the first wall panel contacts the protruding portion of the first flange, and a third distance that is measured orthogonally between the first wall and the exterior surface of the first wall panel is no greater than the first distance; and attaching a second wall panel having an end, an interior surface, and an exterior surface opposing the interior surface to the second wall such that the end of the second wall panel is located adjacent to a second side of the corner protrusion that opposes the first side thereof, the interior surface of the second wall panel contacts the protruding portion of the second flange, and a fourth distance that is measured orthogonally between the second wall and the exterior surface of the second wall panel is no greater than the second distance.

14. The method of claim 13, wherein the step of attaching the corner bracket to the structure further comprises attaching the flat portion of the first flange to the first wall via a fastener and attaching the flat portion of the second flange to the second wall via a fastener.

15. The method of claim 13, further comprising placing the end of the first wall panel in contact with the first surface of the corner protrusion.

16. The method of claim 13, further comprising bending the end of the first wall panel to create a main portion of the first wall panel and a return portion of the first wall panel prior to the step of attaching the first wall panel to the first wall, wherein the step of attaching the first wall panel to the first wall further comprises placing the return portion adjacent to the first surface of the corner protrusion.

17. The method of claim 16, wherein the step of attaching the first wall panel to the first wall further comprises placing the end of the first wall panel in contact with the first surface of the corner protrusion.

18. The method of claim 16, wherein the step of bending the end of the first wall panel further comprises bending the end such that an interior angle having a value between 5 and 90 degrees is formed between the main portion and the return portion.

19. The method of claim 13, further comprising attaching at least one layer of underlayment to the first wall and second wall of the structure prior to attaching any of the corner bracket, first wall panel, or second wall panel to the structure.

* * * * *